US010030322B2

(12) United States Patent
Wilkie et al.

(10) Patent No.: US 10,030,322 B2
(45) Date of Patent: Jul. 24, 2018

(54) METHOD OF FORMING A CONTINUOUS FILAMENT SPUN-LAID WEB

(71) Applicant: Hills, Inc., West Melbourne, FL (US)

(72) Inventors: Arnold Wilkie, Merritt Island, FL (US); James Brang, Melbourne, FL (US); Jeffrey Haggard, Cocoa, FL (US); Angel Antonio De La Hoz, Melbourne, FL (US)

(73) Assignee: HILLS, INC., West Melbourne, FL (US)

( * ) Notice: Subject to any disclaimer, the term of this patent is extended or adjusted under 35 U.S.C. 154(b) by 849 days.

(21) Appl. No.: 14/331,827

(22) Filed: Jul. 15, 2014

(65) Prior Publication Data

US 2015/0017411 A1 Jan. 15, 2015

Related U.S. Application Data

(60) Provisional application No. 61/846,152, filed on Jul. 15, 2013, provisional application No. 61/986,465, filed on Apr. 30, 2014.

(51) Int. Cl.
*B32B 27/32* (2006.01)
*B32B 27/36* (2006.01)
(Continued)

(52) U.S. Cl.
CPC ..... *D01F 8/14* (2013.01); *D01D 5/098* (2013.01); *D01F 8/06* (2013.01); *D04H 3/018* (2013.01);
(Continued)

(58) Field of Classification Search
CPC ..... B32B 27/32; B32B 27/36; D01D 5/08; D01D 5/24; D01D 5/32; D01D 5/34;
(Continued)

(56) References Cited

U.S. PATENT DOCUMENTS 3,556,030 A 1/1971 Stevenson
3,692,618 A 9/1972 Dorschner et al.
(Continued)

FOREIGN PATENT DOCUMENTS

CN 1599818 A 3/2005
CN 102164741 A 8/2011
(Continued)

OTHER PUBLICATIONS

International Search Report and the Written Opinion, PCT/US2014/046669, dated Sep. 24, 2014, 9 pages.
(Continued)

*Primary Examiner* — Leo B Tentoni
(74) *Attorney, Agent, or Firm* — Edell, Shapiro & Finnan, LLC

(57) ABSTRACT

A continuous filament spun-laid web includes a plurality of polymer fibers within the web, the web having a first thickness and the web being free of any thermal or mechanical bonding treatment. Activation of the web results in at least one of an increase from the first thickness prior to activation to a second thickness post activation in which the second thickness is at least about two times greater than the first thickness, a decrease in density of the web post activation in relation to a density of the web prior to activation, the web being configured to withstand an elastic elongation from about 10% to about 350% in at least one of a machine direction (MD) of the web and a cross-direction (CD) of the web, and the web having a tensile strength from about 50 gram-force/cm$^2$ to about 5000 gram-force/cm$^2$.

11 Claims, 6 Drawing Sheets

(51) Int. Cl.

| | |
|---|---|
| ***D01D 5/08*** | (2006.01) |
| ***D01D 5/24*** | (2006.01) |
| ***D01D 5/32*** | (2006.01) |
| ***D01D 5/34*** | (2006.01) |
| ***D01D 5/36*** | (2006.01) |
| ***D01D 7/00*** | (2006.01) |
| ***D01D 10/02*** | (2006.01) |
| ***D02J 13/00*** | (2006.01) |
| ***D04H 3/007*** | (2012.01) |
| ***D04H 3/011*** | (2012.01) |
| ***D04H 3/147*** | (2012.01) |
| ***D01F 8/14*** | (2006.01) |
| ***D01F 8/06*** | (2006.01) |
| ***D04H 3/018*** | (2012.01) |
| ***D04H 3/08*** | (2006.01) |
| ***D01D 5/098*** | (2006.01) |

(52) U.S. Cl.

CPC ..... *D04H 3/08* (2013.01); *Y10T 442/601* (2015.04); *Y10T 442/612* (2015.04); *Y10T 442/638* (2015.04); *Y10T 442/64* (2015.04); *Y10T 442/641* (2015.04); *Y10T 442/681* (2015.04)

(58) Field of Classification Search

CPC . D01D 5/36; D01D 7/00; D01D 10/02; D01F 8/06; D01F 8/14; D02J 13/00; D04H 3/007; D04H 3/011; D04H 3/147

USPC .... 264/103, 172.12, 172.13, 172.14, 172.15, 264/172.17, 172.18, 177.13, 211.12, 264/211.2, 234; 156/181

See application file for complete search history.

(56) References Cited

U.S. PATENT DOCUMENTS 5,135,787 A * 8/1992 Bair ..... B65D 81/265 206/204
5,143,779 A 9/1992 Newkirk et al.
5,162,074 A 11/1992 Hills
5,302,220 A 4/1994 Terakawa et al.
5,399,423 A 3/1995 McCullough et al.
5,525,706 A 6/1996 Gruber et al.
5,575,874 A 11/1996 Griesbach, III et al.
5,733,490 A 3/1998 Phillips et al.
5,811,178 A 9/1998 Adam et al.
5,876,840 A 3/1999 Ning et al.
5,883,069 A * 3/1999 Childs ..... D04H 3/16 510/491
6,153,138 A * 11/2000 Helms, Jr. ..... D01D 5/253 264/172.12 X
6,158,204 A 12/2000 Talley et al.
6,169,045 B1 1/2001 Pike et al.
6,183,684 B1 2/2001 Lu
6,207,246 B1 3/2001 Moren et al.
6,234,886 B1 5/2001 Rivard et al.
6,261,164 B1 7/2001 Rivard et al.
6,302,930 B1 10/2001 Lux
6,306,499 B1 10/2001 Ochi et al.
6,454,989 B1 9/2002 Neely et al.
6,588,080 B1 7/2003 Neely et al.
6,613,704 B1 9/2003 Arnold et al.
6,635,136 B2 10/2003 White et al.
6,797,360 B2 9/2004 Varona
6,867,156 B1 3/2005 White et al.
6,998,164 B2 2/2006 Neely et al.
7,115,535 B1 10/2006 Smith, III et al.
7,179,412 B1 2/2007 Wilkie et al.
7,291,239 B2 11/2007 Polanco et al.
7,297,239 B2 11/2007 Polanco et al.
7,319,077 B2 1/2008 Mehta et al.
7,393,371 B2 7/2008 O'Gary et al.
7,425,517 B2 9/2008 Deka et al.
7,476,632 B2 1/2009 Olson et al.
7,790,640 B2 9/2010 Chakravarty et al.
2001/0044610 A1 11/2001 Kim et al.
2001/0054777 A1 12/2001 White et al.
2002/0089079 A1 7/2002 Shelley et al.
2002/0090499 A1 7/2002 Shelley et al.
2003/0039817 A1 2/2003 Varona
2003/0104745 A1 6/2003 Curtis
2003/0118777 A1 6/2003 Chang et al.
2003/0153230 A1 8/2003 Chen
2003/0213109 A1 11/2003 Neely et al.
2004/0041307 A1* 3/2004 Topolkaraev ..... D01F 8/06 264/103 X
2004/0077247 A1 4/2004 Schmidt et al.
2004/0097155 A1 5/2004 Olson et al.
2004/0111848 A1* 6/2004 Miyamoto ..... A61F 13/15699 28/165
2005/0020170 A1 1/2005 Deka et al.
2005/0098256 A1 5/2005 Polanco et al.
2005/0148267 A1 7/2005 Moody, III et al.
2005/0223649 A1 10/2005 O'Gary et al.
2005/0268420 A1 12/2005 Curtis
2006/0234591 A1 10/2006 Moody, III et al.
2007/0035058 A1* 2/2007 Ogle ..... D04H 1/06 264/113
2008/0014818 A1* 1/2008 Privitera ..... D04H 1/06 442/213
2008/0127572 A1 6/2008 Ludwig
2008/0132862 A1 6/2008 Collias et al.
2009/0004942 A1* 1/2009 Pedoja ..... B32B 5/022 264/211.12 X
2010/0044909 A1 2/2010 Haskett et al.
2010/0124864 A1 5/2010 Dharmarajan et al.
2010/0147621 A1 6/2010 Gillette
2010/0310810 A1 12/2010 Bond et al.
2010/0310837 A1 12/2010 Bond et al.
2010/0310845 A1 12/2010 Bond et al.
2010/0312208 A1 12/2010 Bond et al.
2010/0312211 A1 12/2010 Bond et al.
2010/0312212 A1 12/2010 Bond et al.
2011/0191994 A1* 8/2011 Takahashi ..... D04H 1/498 28/167
2011/0250816 A1 10/2011 Fujiwara et al.

FOREIGN PATENT DOCUMENTS

CN 102458334 A 5/2012
WO 0356086 A1 7/2003
WO 03056089 A1 7/2003

OTHER PUBLICATIONS

Extended Search Report in counterpart European Application No. 14826879.0, dated Nov. 16, 2016 , 7 pages.
Office Action in corresponding Chinese Application No. 201480049181.5, dated Dec. 2, 2016, 3 pages.
Office Action in corresponding Canadian Application 2,918,525, dated Jan. 26, 2017, 3 pages.
Office Action in corresponding Korean Application 10-2016-7003076, dated Mar. 22, 2017, 7 pages.
Office Action in corresponding Japan Application 2016-527030, dated Apr. 25, 2017, 5 pages.
International Search Report in counterpart International Application No. PCT/US2014/046669, dated Nov. 6, 2014.

* cited by examiner

METHOD OF FORMING A CONTINUOUS FILAMENT SPUN-LAID WEB

CROSS-REFERENCE TO RELATED APPLICATIONS

This application claims priority from U.S. Provisional Patent Application Ser. No. 61/846,152, entitled "Self-Bonding, Bulky, Uniform, Stretchy Spunbond Process and Fabric", filed Jul. 15, 2013, and also from U.S. Provisional Patent Application Ser. No. 61/986,465, entitled "High Lofted Spunbond Fabric", filed Apr. 30, 2014. The disclosures of these provisional patent applications are incorporated herein by reference in their entireties.

FIELD

The present invention relates to spun-laid processes and nonwoven webs of fibers for forming fabrics and other products.

BACKGROUND

A "spun-laid" process, as used herein, refers to a process in which one or more polymers are melted, extruded, air quenched, drawn (for example, by air, godet rolls and/or any other types of suitable devices), and deposited as solidified fibers onto a suitable laydown or support surface (such as a porous belt) to form one or more nonwoven layers of fibers (also referred to herein as a "spun-laid web"). An example of one type of a so-called "closed system" spun-laid process is described by U.S. Pat. No. 7,179,412, the disclosure of which is incorporated herein by reference in its entirety, where attenuation of the extruded fibers is in large part created by acceleration of the same air used to quench the fibers. Another example is a so-called "open system" as described by U.S. Pat. No. 6,183,684, the disclosure of which is incorporated herein by reference in its entirety, where the attenuation of the extruded fibers is in large part created by a compressed air aspirator. In an open system, there may be only one curtain of fibers from a single spinneret and only one air aspirator, or there may be several spinnerets and several air aspirators in the cross-direction (CD) and/or machine direction (MD). In both systems, fibers covering a width up to several meters wide are deposited onto a similar width porous belt. The velocity of the fibers is usually several times the velocity of the porous belt. In addition, a fabric is typically formed having fibers oriented more in the direction of the porous belt travel (so called Machine Direction or "MD") than in the direction perpendicular to the direction of the porous belt travel (so called Cross-Direction or "CD").

The nonwoven web of fibers formed by conventional open and closed spun-laid systems does not result in a strong fabric. Fabric strength is typically imparted by another processing step to produce a bonded fabric, resulting in the so called "spunbond" process and spunbond web of fibers. The most common bonding technique used in spunbond processes is thermal bonding. In thermal bonding, a strong web is produced by subjecting the web to heat sufficient to partially melt some fibers or portions of some fibers to form a bound between the fibers on re-solidification. Thermal bonding includes calender bonding as well as through air bonding. In calender bonding, the nonwoven web is processed between at least two nip rolls, at least one of which is heated to a temperature sufficient to at least partially melt at least the surface of some fibers while subjecting the web to pressure between the rolls. Thermal bonding also includes the so called through air bonding technique where air is sufficiently heated and passed through the web to partially melt at least the surface of some fibers. Other known bonding techniques involve applying mechanical forces to the web sufficient to tangle or interlock the fibers to form a strong web. Such processes include needling and hydroentangling, both of which make a more three-dimensional nonwoven spunbond web as some fibers are caused to protrude from the surface. All of these bonding techniques require use of expensive and energy intensive additional machinery.

For a number of reasons, it is desirable to make a spun-laid web of fibers having sufficient bulkiness and loft (increased thickness or increase in "Z" dimension). Needling and hydroentangling processes can provide some level of bulkiness and loft but only in a relatively modest amount. Attempts have been made to make spunbond fabrics more lofty and bulky via spinning of multi-component fibers (i.e. fibers consisting of multiple discrete polymer constituents in the fiber cross section, such as bicomponent fibers) in which two or more polymer constituents have differential strain or differential shrinkage to impart curling or bending of the fibers in the web after thermal and/or mechanical treatment. An example of suitable processing apparatus for producing multi-component fibers is described, for example, in U.S. Pat. No. 5,162,074, the disclosure of which is incorporated herein by reference in its entirety. Thermal or mechanical treatment of such fibers to induce curling and/or bending of the fibers typically is performed after bonding of the web of fibers has occurred. Such processes have only been moderately successful in producing enhanced loftiness and bulk in the spunbond web, due in part to the weak or restrained bending forces normally inherent in such processes (since the fibers in the bonded web are restrained from movement and do not have the power to bend).

It is also desirable to manufacture a more uniform fabric in both appearance and physical properties. For example, techniques are known for controlled management of the large amount of air involved in the Spunbond process, particularly in open systems. Such air management is difficult and has proved to be a significant limitation in making more uniform Spun Bond fabrics.

It is further desirable to produce spunbond fabrics that are stretchy using, for example, special elastomeric polymers (such as TPU and Krayton®) in producing the fibers for the spunbond web. However, such special elastomeric polymers tend to be more expensive than normal, conventional spunbond polymers. In addition, elastomeric polymers are generally more difficult to process due to issues such as "tackiness" of the fibers and the low spinning speeds (i.e., the speed that extruded filaments attain between the spinneret and the lay down surface) typically required to process such polymers. The resultant fabrics formed utilizing such polymers can also have certain deficiencies, such as a tacky hand, difficulty and impossibility to dye with colors. Utilizing such special elastomeric polymers can also result in fabrics formed that tend to exhibit considerably more stretch in the MD than in the CD.

SUMMARY

A continuous filament spun-laid web comprises a plurality of polymer fibers within the web, the web having a first thickness and the web being free of any thermal or mechanical bonding treatment. Activation of the web results in at least one of an increase from the first thickness prior to activation to a second thickness post activation in which the second thickness is at least about two times greater than the first thickness, a decrease in density of the web post activation in relation to a density of the web prior to activation, the web being configured to withstand an elastic elongation from about 10% to about 350% in at least one of a machine direction (MD) of the web and a cross-direction (CD) of the web, and the web having a tensile strength from about 50 gram-force/$cm^2$ to about 5000 gram-force/$cm^2$.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION

Figure 1A:
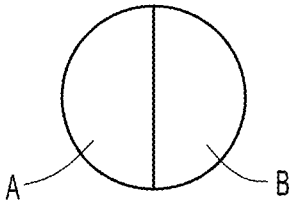
FIGS. 1A-1E are cross-sectional views showing different multi-component fiber geometries.

As described herein, a continuous filament spun-laid web is formed that, when activated after formation of the web, achieves a suitable bulk and loftiness and/or a suitable stretchiness or elasticity and/or suitable strength properties and/or a suitably low density with improved web uniformity and/or suitable barrier properties without requiring any specific mechanical and/or thermal bonding process being applied to the fibers (i.e., no calender bonding, hydroentangling, through air bonding, needling, point bonding, etc. is required). Suitable barrier properties of continuous filament spun-laid webs formed in accordance with the present invention can include, without limitation, a barrier that impedes transfer of solids and/or liquids, a barrier that impedes or limits thermal energy transfer through the web, a sound barrier (impeding or limiting transfer of sound waves through the web), a mechanical energy barrier or shock absorber (impeding or limiting transfer of mechanical energy through the web), etc.

In example embodiments, activation of the spun-laid continuous filament web that is formed in accordance with the present invention includes fibers within the web that mechanically bond or achieve a bonding like engagement with each other as a result of the activation process that induces the loftiness and/or elasticity and/or high strength to the web, where the bonding like effect is achieved based upon the entangling of fibers with other fibers in the web. In certain example embodiments, activation of the spun-laid web results in one or more of increase in loftiness/bulkiness of the web, improved web uniformity, increased stretchiness or elasticity of the web, increased tensile strength in the MD and CD dimensions of the web, decreased density and enhanced barrier properties of the web.

The term "continuous filament spun-laid web", as used herein, refers to spun-laid web comprising continuous filaments formed from a spun-laid process, where the web fibers have not been cut but instead are collected (for example, wound on a roller or winder) as the web is being continuously formed. A continuous filament spun-laid web has not been subjected to any bonding treatment (thermal or mechanical) separate from the activation treatment of the web as described herein.

The term "activation", as used herein, refers to a change in certain characteristics of the continuous filament spun-laid web after formation of the web, where the activation occurs without any bonding technique being externally applied to the web (i.e., no mechanical and/or thermal bonding applied to the web by equipment of the spun-laid or other process, such as calender bonding, through air bonding, needle punching, point bonding, hydroentangling, etc. being applied to the web). The characteristics imparted to the spun-laid web in response to activation can include one or more of an increase in web bulk or loftiness, a decrease in web density, an increase in web elasticity, and an increase in web tenacity while further achieving desired web uniformity and desirable web barrier properties after activation.

An increase in web loftiness after activation of the continuous filament spun-laid web can be characterized by a change in the thickness (change in "Z" dimension) by an amount of at least about 2× (two times), at least about 3×, at least about 4×, at least about 5×, at least about 10×, at least about 20×, at least about 30×, at least about 40×, at least about 50× or even greater when comparing the web thickness before and after activation. In addition, the web undergoes a significant change in web density after activation. Web thicknesses for activated continuous filament spun-laid webs formed in accordance with the present invention can be from about 0.020 inches (about 0.50 mm) to about 3.0 inches (about 76 mm) or greater, while web densities for such activated spun-laid webs can be from about 0.002 g/$cm^3$ to about 0.25 g/$cm^3$. Loftiness of the activated continuous filament spun-laid web can further be characterized, for example, based upon compression forces applied to the web utilizing ASTM standard test methods for flexible materials, such as indentation force deflection (IFD) tests performed according to ASTM D3574 (standard published by ASTM International, the disclosure of which is incorporated herein by reference in its entirety). Example embodiments of lofty spun-laid webs formed in accordance with the present invention can have properties including at least one of a tensile strength of at least about 300 gram-force/$cm^2$ and an indentation force deflection (IFD) of at least about 5 gram-force/$cm^2$ to deflect the web so as to reduce web thickness by 65%. As used herein, the term "gram-force" is understood to mean a gravitational metric unit of force (i.e., the magnitude of force exerted by a mass in grams within a standard field of gravity of 9.80665 m/$s^2$), where 1 gram-force is equivalent to 9.80665 mN (milliNewtons).

The loftiness of certain continuous filament spun-laid webs formed in accordance with the present invention can further be characterized by the degree of entanglement of fibers within the activated web. In particular, the amplitude and frequency of a curved path defined by an entangled fiber within a web can be used to characterize a degree of loftiness of the web, where large amplitudes and lower frequencies associated with entangled fibers within a web provide an indication of a loftier web in relation to other webs having smaller amplitudes and higher frequencies associated with entangled fibers in the other webs. In contrast, continuous filament spun-laid webs formed in accordance with the present invention and having smaller amplitudes and higher frequencies associated with entangled fibers within the webs exhibit unique tensile strength properties as described herein.

In certain embodiments, the continuous filament spun-laid web can also decrease from about 2% to about 75% in MD dimension (length of web) from its original MD dimension to its final MD dimension after activation, while the continuous filament spun-laid web also decreases from about 2% to about 50% in CD (width of web) from its original CD dimension to its final CD dimension after activation.

In certain embodiments, the continuous filament spun-laid web increases in strength in both the MD and CD by at least about 2× (two times) after activation in comparison to web strength before activation. The strength of the web can be characterized, for example, by tensile strength tests performed in both the MD and CD of the web, where the web withstands a force applied to the MD or CD side without failing (without breaking or shearing). In particular, the tensile strength of a continuous filament spun-laid web formed in accordance with the present invention can be from about 50 g/cm$^2$ (gram-force/cm$^2$) to about 5000 g/cm$^2$ (gram-force/cm$^2$) in the MD dimension or CD dimension.

The activated spun-laid web can also become stretchy or elastic in its MD and CD dimensions. The elasticity of the activated spun-laid web can be characterized by a stretching or elastic elongation permitted by the web (i.e., the web can withstand such stretching or elongating of the web) in its MD dimension and/or its CD dimension from at least about 10% to as much as about 350% (percent increase from original dimension to an elastic elongated dimension when stretching the web) without tearing or failure of the web. The term "elastic elongation", as used herein, refers to a stretching or elongation of the web in its MD dimension or its CD dimension that is elastic in that, upon removal of a force applied to the web causing such stretching or elongation, the web at least partially recovers by contracting to a final dimension as indicated by a % recovery as described herein. The stretching of the web is performed by applying different weight loads to a web sample in both the MD and CD dimensions and measuring a change in dimension from the original (unloaded) dimension to a final (loaded) dimension. A recovery of the web can also be determined by measuring the dimension of the web sample after removal of the weight load applied to the web sample and comparing this recovered dimension with the original dimension. The activated spun-laid webs of the present invention exhibit a recovery of at least about 40%, and in certain webs at least about 50% or more (for example, about 90% to about 100%), after being elongated in the manner described herein.

Activated continuous filament spun-laid webs formed in accordance with the present invention can also exhibit thermal conductivity properties from about 30 mW/m-K to about 50 mW/m-K (as measured based upon ASTM C518 (2004)).

For certain types of products formed from the continuous filament spun-laid webs of the present invention, no bonding of the web is necessary after activation to achieve the lofty, tensile strength and/or elastic properties as described herein, since the entangling of fibers within the web in response to activation provides a suitable interlocking or self-bonding effect between the fibers of the web to yield one or more of effective web bulk and loft, web strength, web elasticity, and web uniformity. Alternatively, for other types of products formed from the continuous filament spun-laid webs of the present invention, it may be desirable to further bond the fibers within the activated spun-laid web utilizing any known or other suitable techniques (for example, calender bonding, through air bonding, needle punching, point bonding, hydroentangling, etc.).

Activation of the fibers in the continuous filament spun-laid web occurs after the web has been formed and prior to collection of the web (for example, rolling or winding the web onto a collection roll or winder). The web is maintained in a substantially un-restrained state to facilitate activation (for example, the web is resting freely on a solid surface, on or within a liquid or gaseous medium, etc. and with no restraining forces being applied to the web), such that the fibers of the web can freely move in relation to each other so as to crimp, bend and entangle with each other to mechanically interlock with each other as activation occurs. Further, since the spun-laid fibers are not bonded together or are substantially un-bonded (for example, "substantially un-bonded" indicates that less than 10% of the fibers within the web are bonded together) after being formed and laid down on a web forming surface, this further prevents any restraining of the fibers within the web prior to activation. By further supporting the web during activation such that there is substantially no restraint on any surface of the web will ensure the activation process is most effective in a resultant lofty web having desired properties.

In example embodiments, activation of the web comprises heating of the web while the web is maintained in a substantially un-restrained state, where no external force is applied to the web of fibers while the fibers are being heated. In other example embodiments, no heat is necessary to activate the spun-laid web of fibers. In such embodiments in which heat is not needed, activation of the spun-laid web occurs in response to the fibers being formed and laid down in a substantially un-restrained state (subsequent to being extruded and drawn, where the fibers are laid down and allowed to freely move in relation to one another to facilitate activation). In still further example embodiments, activation of a continuous filament spun-laid web in accordance with the present invention by partial activation of the web without heat and then further and/or complete activation by exposure of the web to heat.

Figure 5:
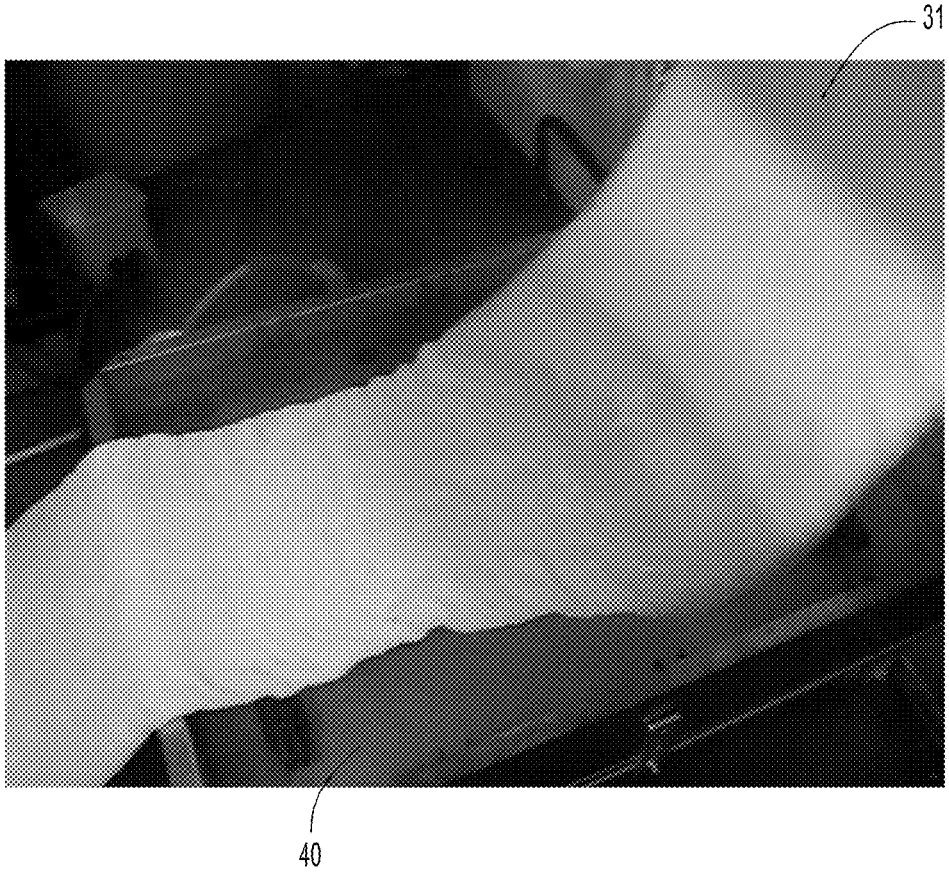
FIG. 5 is an image showing activation of a spun-laid web (with an optional thermal/mechanical bonding step) passing through a boiling water bath in accordance with an example embodiment of the present invention.

One example of a type of heating equipment configured to ensure adequate heating of fibers while maintaining substantially no restraint on the fibers comprises a vessel or bath of heated fluid (for example, boiling water or steam, or any other suitable heated liquid) into which the spun-laid web is directed from the web forming surface, where the web is directed so as to pass from the web forming surface into the heated bath and the fibers within the web are free to move relative to each other as they are being heated. In particular, fibers passing through a heated bath (for example boiling water) may float through the bath in a supported yet virtually un-restrained state so as to allow at least some heated fibers to crimp or bend thus inducing a loftiness to the web in which a "Z" dimension of the web increases and/or an elasticity in the MD and/or CD dimensions of the web. In an example embodiment depicted in the image of FIG. 5, the effect of passing a spun-laid web 31 formed in accordance with the present invention into a bath of heated water is evident, where the MD dimension (length) and/or CD dimension (width) of the web decreases as it is activated by the heat treatment from the heated bath 40 (moving from right to left within the image of FIG. 5).

Any other suitable heat source (for example, a radiation and/or convection heat source such as an oven through which the fibers pass) can also be utilized so long as the fibers are maintained in a substantially un-restrained environment such that the fibers are free to move during the heat activation process. Suitable temperatures for heating the web to induce activation will depend upon the particular polymers utilized to form the fibers such that the temperatures are preferably no greater than the lowest melting point of such polymers. Such temperatures do not melt the polymer components of the fibers forming the web, such that the resultant web strength is generated not from thermal and/or mechanical bonding of fibers but instead by the entangling or intertwining of the fibers within the web. In certain embodiments, activation utilizing heat can also heat set the entangled fibers in their crimped and entangled positions.

In such embodiments, at least some of the fibers of the spun-laid web are formed from different polymer components. For example, a spun-laid web can comprise multi-component fibers formed from two or more different polymer components (for example, bicomponent fibers). In another example, a spun-laid web can comprise a plurality of mixed homo or single component fibers, where each fiber is formed of a single polymer component and two or more fibers in the plurality are formed from different polymer components. In a still further example, a spun-laid web can comprise single component fibers and multi-component fibers formed from different polymer components.

As used herein, "different polymer components" refers to two different types of polymers (such as polypropylene and polylactic acid) as well as two different grades of the same type of polymer (for example, two different grades of polyethylene terephthalate or any other type of polymer having different levels of cross-linking, different levels of crystallization during solidification from a melt form, including different additives and/or any other differences that result in differences in physical characteristics for the different grades of the same polymer type).

Some examples of polymer components that can be used to form spun-laid webs in accordance with the present invention include, without limitation, polyolefins (for example, polyethylene, polypropylene, polybutylene, etc.), polyesters (for example, polyethylene terephthalate (PET), polyethylene naphthalate (PEN), polytrimethylene terephthalate (PTT) and polybutylene terephthalate (PBT), polyacrylamides, polyurethanes, polylactic acids (PLA); polyamides (for example, Nylon 6, Nylon 6,6 and Nylon 6,10), polyvinyl alcohol (PVA, for example, ethylene vinyl alcohol) and/or any variety of grades (for example, different grades of PLA, different grades of polypropylene, different grades of PET, etc.) and/or block copolymers or any other combinations of such polymer types.

Some examples of different polymer cross-sections (i.e., where each cross-section is transverse the lengthwise dimension of a fiber) for homo or multi-component fibers that can be provided within the spun-laid webs in accordance with the present invention include, without limitation, round, non-round (for example, elliptical), multi-faceted (for example, triangular) and multi-lobal (for example, tri-lobal), sheath-core (for example, symmetrical or eccentric), hollow round or any other hollow geometry, and islands-in-the-sea. Multi-component fibers can include different polymer components within any one or more portions and at any suitable ratios within a fiber. For example, a side-by-side bicomponent fiber can be formed that includes different polymer components A and B as depicted in the fiber cross-section of FIG. 1A. In another example, a fiber cross-section of FIG. 1B depicts a sheath-core fiber with different polymer components A and B located in the core and sheath, respectively. As depicted in FIG. 1C, an eccentric sheath-core fiber includes polymer components A and B in the core and sheath, respectively. A tri-lobal fiber cross-section is depicted in FIG. 1D, in which polymer components A and B are located within the main central portion of the fiber and the lobes of the fiber, respectively. A hollow (for example, round hollow) fiber cross-section is depicted in FIG. 1E, in which polymer components A and B form circumferential sections of the hollow fiber. A large variety of other fiber geometries can also be utilized in forming fibers for the spun-laid webs according to the present invention.

The ratios of polymer components in the bicomponent geometries described by FIGS. 1A-1E can be any suitable ratios, such as volumetric ratio of 50/50 of polymer A to polymer B (or vice versa), and larger ratios of one polymer type to another, such as a volumetric ratio of 60/40 of polymer A to polymer B (or vice versa), a volumetric ratio of 70/30 of polymer A to polymer B (or vice versa), a volumetric ratio of 80/20 of polymer A to polymer B (or vice versa), a volumetric ratio of 90/10 of polymer A to polymer B (or vice versa), and a volumetric ratio of 95/5 of polymer A to polymer B (or vice versa).

Any suitable combination of polymer components and fiber geometries can be utilized to obtain the spun-laid webs in accordance having suitable loftiness, suitable elasticity and/or other desired properties upon activation in accordance with the invention. In example embodiments in which activation is achieved by heat treatment, a combination of two or more polymer components for fibers having different degrees of shrinkage and/or crimping characteristics in response to heat treatment can be used to achieve the desired entangling of fibers and resultant lofty web. By way of non-limiting example, a high shrinkage polymer component within a fiber may be aliphatic and also amorphous or have a smaller degree of crystallization and a lower chain modulus in relation to another polymer component to induce a desired level of crimping or bending for the fiber in relation to other fibers in the web. In addition, spun-laid webs can be formed in accordance with the present invention in which the same fiber geometries (same fiber cross-sectional shapes) are provided within the web or, alternatively, the web includes a mixture of two or more different fiber geometries (different fiber cross-sectional shapes).

The location(s) of one polymer component type (for example, a high thermal shrinkage polymer component) in relation to another polymer component type (for example, a lower shrinkage polymer component type) within a multi-component fiber can also be configured to achieve a desired degree of crimping of the fiber which will affect the resultant properties of the web after activation. For example, in a sheath-core fiber, it may be desirable to provide a higher thermal shrinkage polymer component within the sheath portion of the fiber and a lower thermal shrinkage (faster crystallizing during fiber spinning/formation) polymer component in the core portion of the fiber. In addition, two adjacent polymer components in a multi-component fiber (such as sheath-core, hollow or side-by-side) can be selected that have sufficient differences in surface energy so as to facilitate some level of slipping or sliding between the adjacent polymer components within the fibers during web activation, thus enhancing crimping and entangling of fibers.

Resultant properties of an activated web can also be controlled based upon fiber size or denier. For example, continuous filament spun-laid webs of the present invention can be formed having fiber sizes in the range from about 0.5 denier to about 15 denier (about 5 microns to about 50 microns in diameter or other cross-sectional dimension).

Accordingly, a number of parameters can be selected to influence or enhance activation to affect or control a degree of change for at least one of web loftiness, web density, web elasticity, web uniformity, web strength and web barrier properties in the resultant web. In particular, the degree of activation in relation to the resultant properties of the web can be influenced by any one or combination of selection of different polymer components, selection of different fiber cross-sectional geometries or combinations of two or more different types of fiber cross-sectional geometries for a web, location of different polymer types within a fiber cross-section (for example, selection of a specific polymer type for one section of a fiber, such as the sheath of a sheath-core fiber and selection of another polymer type for another section of a fiber, such as the core of a sheath-core fiber), selection of polymer component volumetric ratios within multi-component fibers (for example, a 95/5 ratio of polymer A to polymer B in a bicomponent fiber), and selection of fiber sizes for forming the web.

Formation of the lofty spun-laid webs of the present invention can be achieved utilizing any suitable web spinning and formation process including, without limitation, open and closed spunbond systems as previously described herein and as referenced by examples depicted in U.S. Pat. Nos. 6,183,684 and 7,179,412. Spun-laid webs formed in accordance with the invention can be formed of continuous filament webs, where the web of fibers is continuously formed and then collected in any suitable manner (for example, rolled onto a winder) without cutting the webs into smaller lengths.

The webs can further be formed as a single layer structure or a multi-layer structure/ For example, a continuous filament spun-laid web can be formed with two or more layers stacked upon each other in the thickness or "Z" dimension of the web, where fibers are extruded and laid down at different locations along the MD of the system so as to form different filament layers. The different filament layers can be formed via the same spun-laid process or by different processes, such as a melt blown process (so as to form, for example, a spun-laid/melt blown/spun-laid or SMS multi-layer web). Alternatively, a continuous filament spun-laid web can be formed in which fibers are folded upon each other in a "shingled" manner during web formation (for example, by adjusting the process such that the laydown speed is faster than the speed of the web forming surface) such that a single laydown of fibers resembles a multi-layer web, particularly when the fibers entangle with each other in response to activation. When forming a web with multiple layers, some layers can be formed so as to activate in accordance with the present invention while other layers do not. For example, a plurality of continuous filament layers can be formed stacked upon each other (in the "Z" dimension, or dimension that is transverse both the MD and CD dimensions of the web) to form a thick continuous filament web material of about 12 inches (about 30.5 cm) or greater. The layers within the web can further be bonded in any suitable manner after web activation utilizing multi-layer bonding techniques that include, without limitation, utilizing bonding materials (such as bonding fibers, bonding powders, bonding foam or liquid materials, etc.) and/or any other known bonding techniques (for example, calender bonding, hydroentangling, through air bonding, needling, point bonding, etc.).

Figure 2:
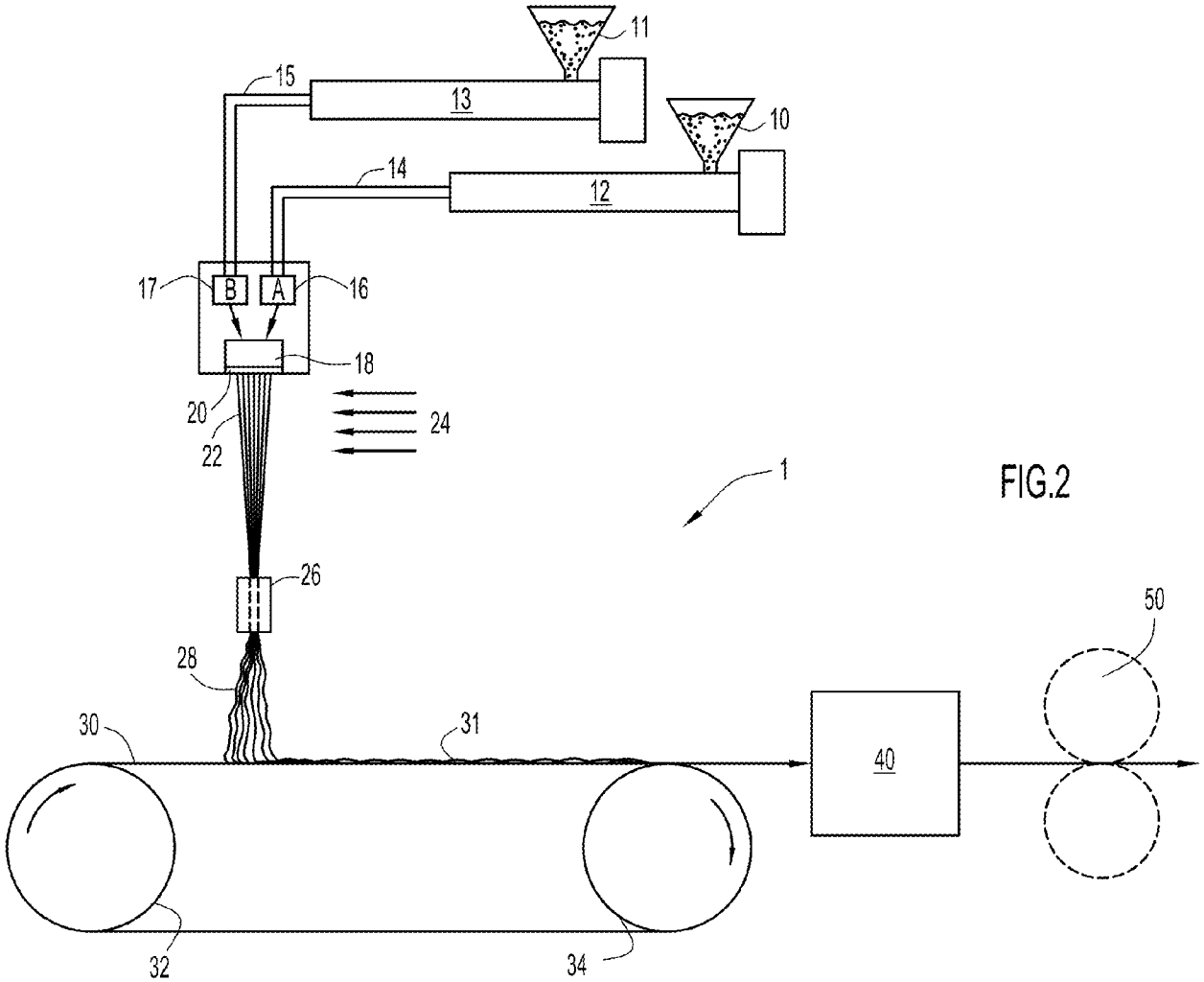
FIG. 2 is a diagrammatic view of a spun-laid system for forming spun-laid webs of fibers in accordance with an example embodiment of the present invention.

A non-limiting example of an open system for producing continuous filament spun-laid webs in accordance with the present invention is illustrated in FIG. 2. Spun-laid system 1 includes a first hopper 10 into which pellets of a first polymer component A are placed. The polymer is fed from hopper 10 to screw extruder 12, where the polymer is melted. The molten polymer flows through heated pipe 14 into metering pump 16 and spin pack 18. A second hopper 11 feeds a second polymer component B into a screw extruder 13, which melts the polymer. The molten polymer flows through the heated pipe 15 and into a metering pump 17 and spin pack 18. Polymer components A and B are selected from groups as described herein so as to achieve a suitable spun-laid web having sufficient loftiness and elasticity upon activation of the web in the manner described herein. Spin pack 18 includes a spinneret 20 with orifices through which fibers 22 are extruded. The design of the spin pack is configured to accommodate multiple polymer components for producing any types of polymer fibers such as the previously noted plural component fibers having any desired cross-sectional geometries. An example embodiment of a suitable spin pack that may be utilized with the system is described in U.S. Pat. No. 5,162,074, the disclosure of which is incorporated herein by reference in its entirety.

The extruded fibers 22 are quenched with a quenching medium 24 (e.g., air), and are subsequently directed into a drawing unit 26, depicted as an aspirator in FIG. 2, to increase the fiber velocity and to attenuate the fibers. Alternatively, it is noted that godet rolls or any other suitable drawing unit may be utilized to attenuate the fibers. The spinning speed of the extruded fibers may be selectively controlled by controlling operating parameters of the metering pump, quench rate of the fibers, and the drawing unit and flow of polymer fluid through the spin pack. Example spinning speeds that are suitable for producing spun-laid webs in accordance with the invention include speeds in the range of about 1000 MPM (meters per minute) to about 8000 MPM.

Upon exiting the drawing unit 26, the attenuated fibers 28 are laid down upon a continuous screen belt 30 (for example, supported and driven by rolls 32 and 34). The fibers form a web 31 on the screen belt and are carried by the screen belt for further processing (including activation to induce bulking and loftiness in the web as described herein) and/for storage (for example, by winding the web 31 onto a drum). While a continuous screen belt 30 is described in the system 1 of FIG. 2, it is noted that any suitable web forming surface (e.g., a forming table, drum, roll or any other collection device) may be provided to receive the extruded fibers so as to form the spun-laid web. Optionally, the web 31 can be run through compaction rolls (not shown) or processed in any other manner while being conveyed along the belt 30.

Activation of the fibers to impart at least one of a desired degree of loftiness (increase in web thickness or size of web in the "Z" dimension), a suitably low density, and an acceptable web uniformity, web strength and web elasticity can occur at any suitable location along belt 30 in which the spun-laid web is substantially un-restrained and un-bonded, thus allowing the fibers to move freely in relation to one another. As previously noted, in certain embodiments, activation of the web can occur without any heating of the web but while the fibers are in a substantially un-restrained and substantially un-bonded state. Thus, in such embodiments, activation of the fibers occurs as soon as or shortly after the fibers are laid down on belt 30 to form the web 31 and as the web 31 moves along the belt 30.

In embodiments in which application of heat is required to initiate activation, the heat activation occurs at station 40 within the system 1. This station 40 can include any suitable equipment that facilitates adequate heating of the fibers with minimal or substantially no force or restraint applied to the fibers. As depicted in FIG. 2, station 40 is provided at a location downstream from the belt 30 (or other web forming surface). However, it is noted that station 40 can be provided at any suitable location within the system 1 (for example, at any location along belt 30, at any in-line location within system 1 and/or any other suitable locations). As previously noted, station 40 may comprise a bath of heating fluid (for example, heated and/or boiling water, such as the station depicted in the image of FIG. 5), an oven (for example, heating by steam or other fluid) or any other suitable heating structure that adequately heats the web while not actively imparting any restraining forces upon the web such that the fibers of the web are free to move in relation to each other (e.g., bend and/or crimp) during the heating process. Suitable temperatures that can be utilized to ensure activation of the spun-laid continuous filament web include temperatures of at least about 50° C. to any suitable temperature that is no greater than the lowest melting point of polymer components used to form the fibers of the web.

The activation of the web (spontaneously or induced by heat at station 40 while un-restrained) increases the thickness or "Z" dimension of the web and further reduces the density of the web, since the web thickness expands without the addition of fiber or other material to the web. For example, the selection of different polymer types having different physical characteristics (for example, different amounts or degrees of shrinkage) as well as selection of certain fiber cross-sectional geometries and/or ratios of different fiber components within the fibers of the webs (for example, selection of ratios of two or more different polymer components within certain multi-component fibers, or selection of ratios of two or more sets of single component fibers within the web having different polymer components) affects the degree of change in loftiness and density between the web before activation in relation to the web after activation.

After activation of the web, the web can be collected, for example, by winding the web around a collection roll. Alternatively, the web can be processed in any other suitable manner depending upon a particular application for the web product formed. In optional embodiments, the activated spun-laid web can further be bonded at station 50, utilizing any known or other bonding technique such as calender roll bonding (as shown in FIG. 2), through air bonding, needle punching, point bonding, hydroentangling, etc.

In certain embodiments associated with webs that must be heat activated, it may be desirable to not activate the spun-laid web (for example, eliminate station 40 shown in FIG. 2) but instead collect the web after it has been formed on the web forming surface. For example, the spun-laid web 31 can be conveyed from the belt 30 directly to a winder (for example, a bobbin) for collection of the web. The spun-laid web 31 can then be activated at a later time and in another process, such that the spun-laid web 31 has an activation potential imparted to it that can be realized upon activation at the later time. The activation potential imparted to the spun-laid web refers to a potential that, upon activation of the web, results in at least one of a web thickness that increases by a factor of at least about 2×, a web density that significantly decreases, a web tensile strength that increases and a web elasticity that increases.

The activation potential that is imparted to the spun-laid web without activation can be beneficial for a number of reasons including, without limitation, a reduction in size/space requirements for the product when shipped to an endpoint prior to use. For example, consider the use of the spun-laid web as an insulation or filtration product for different applications. The continuous filament spun-laid web could be manufactured and stored in an intermediate state in which the activation potential is imparted to the web (i.e., no activation of web). The continuous filament spun-laid web, having a thickness that is significantly smaller prior to activation, can be shipped in rolls or in any other suitable configuration such that the shipped product is smaller in size. During use of the spun-laid product, the consumer can activate the web by heating the product (e.g., via an air dryer or any other suitable heat source) prior to use.

Figure 6:
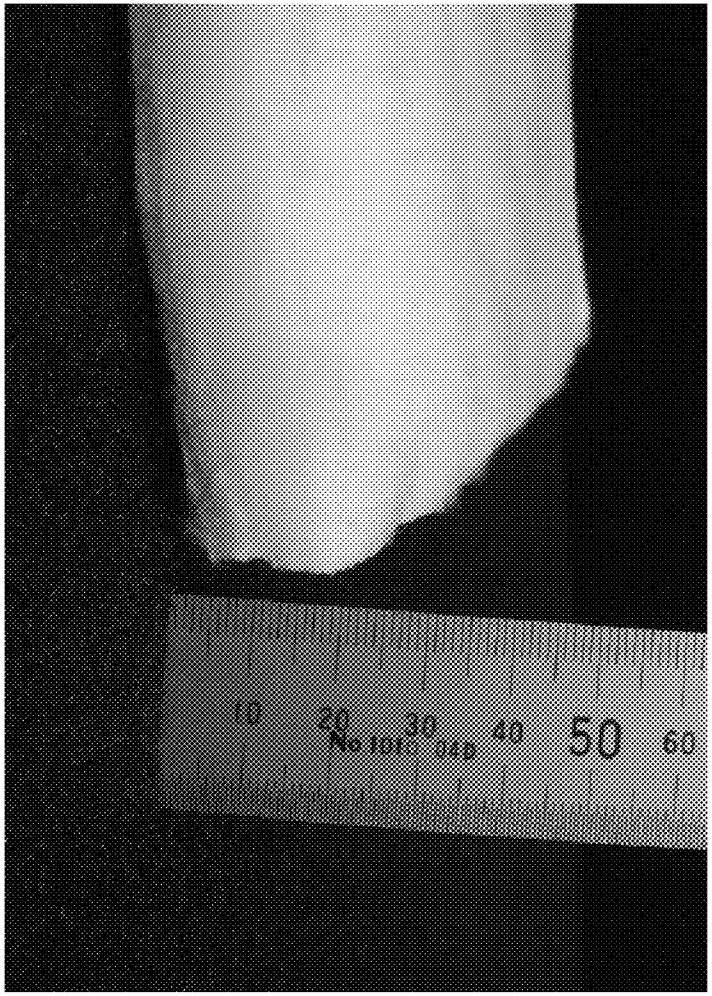
FIG. 6 is an image showing in example embodiment of a sample taken from an activated continuous filament spun-laid web product formed in accordance with the present invention.

An example sample of an activated continuous filament spun-laid web product formed in accordance with the present invention is depicted in the photo image of FIG. 6. The web product has a loftiness as characterized by its thickness of about 20 mm.

Some specific examples of continuous filament spun-laid webs formed in accordance with the present invention and properties associated with the webs are now described.

EXAMPLE 1

Figure 3:
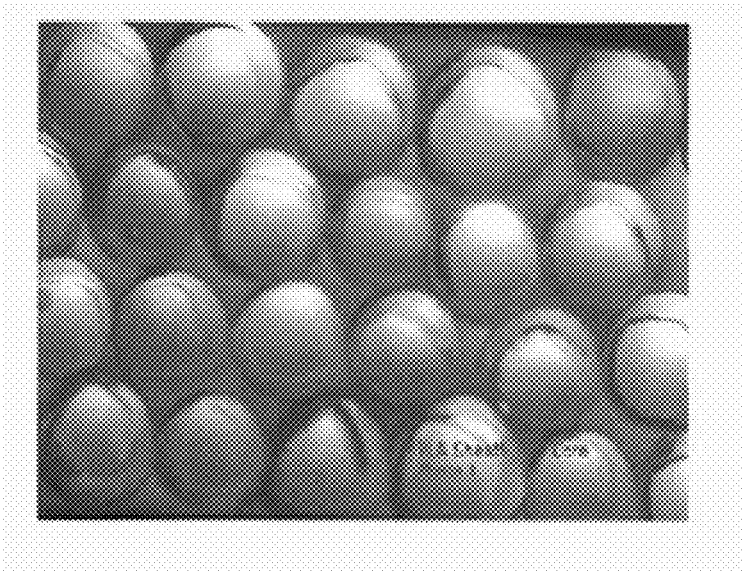
FIG. 3 is an image of the cross-section for a plurality of sheath-core fibers that form a spun-laid web in accordance with an example embodiment of the present invention.

A continuous filament spun-laid web of slightly eccentric sheath-core fibers (e.g., fibers having a geometry as set forth in FIG. 1C) was formed utilizing a system similar to that depicted in FIG. 2. The sheath-core fibers included polylactic acid (PLA) polymer as the sheath (polymer component B in FIG. 1C) and polypropylene as the core (polymer component A in FIG. 1C). In particular, the PLA polymer was obtained from Natureworks LLC (Minnesota) under the tradename PLA 6302, while the polypropylene polymer was obtained from LyondellBassell Industries (Texas) under the tradename PP PH-835. The eccentric sheath-core fibers formed included a slightly non-circular or irregular shaped core. A cross-sectional view of a collection of such fibers formed is depicted in the image of FIG. 3.

The spun-laid web formed from such fibers was not bonded at all on the porous belt. Instead, the web was either wound at a very low tension on a winder that was driven by the porous belt for later heat treatment/web activation or the web was processed in-line with heat treatment to activate the web. In either case, the spun laid web was treated at a station similar to station 40 depicted in FIG. 2, where the station was a tank of boiling water. The web floated at the surface of boiling water as it passed through the tank, resulting in a heat treatment to the fibers of the web that activated the lofty potential with the fibers being in a substantially un-restrained state. The portion of the web emerging from the boiling water was activated and increased in loftiness.

Activation by the heat treatment caused the PLA to shrink to a greater degree than the polypropylene in the fibers, resulting in bending and entangling of the fibers relative to each other. This resulted in some amount of bonding of the fibers together and an increase in thickness or Z-dimension of the web as well as a reduction in web density after activation.

The resultant spun-laid web that was formed after activation also had an excellent fabric strength due to the entanglement of fibers during activation that also generated the increase in web thickness and reduction in web density. The spun-laid web also exhibited excellent fabric uniformity, again due to the bending and entangling of fibers which further provided more opacity to the web (also due to the reduction in web density). The stretchiness or elasticity of the web was also excellent after the fibers were heat activated. The eccentric sheath-core configuration (where the core has a cross-sectional center that does not correspond with the cross-sectional center of the sheath) was used to promote bending and curling of the fibers in response to activation of the web. In addition, the non-circular core cross-sectional geometries of the sheath-core fibers were believed to also contribute to the properties exhibited by the web in response to web activation.

In addition, different sheath/core ratios for the fibers used to form the web were tested to determine the effect on the desired properties of the activated web. In particular, sheath/core volumetric ratios of 25:75 (sheath:core) to 95:5 (sheath:core) were tested, and it was discovered that volumetric ratios of up to 95:5 (sheath:core) were effective to provide lofty, elastic and tensile strength properties for the fibers upon activation. The locations of the polymer components (polypropylene and PLA) in the sheath and core sections of the sheath/core fibers was also changed such that webs were formed with each polymer component being located in the sheath of fibers for some webs and in the core for other webs. The formed webs exhibited suitable lofty, elastic and tensile strength properties in all of the webs formed. However, providing such modification to the fibers can change the hydrophobic/hydrophilic properties of the webs depending upon which polymer components were used to form the sheath and core portions of the web forming fibers.

It was further determined that fabric weights of about 50 $g/m^2$ or less resulted in all of the desired properties in response to activation as noted in this example (increase in web thickness or Z-dimension, decrease in density, and enhanced web strength, web uniformity and web elasticity). In particular, it was determined that a lower fabric weight (in $g/m^2$) resulted in a more stretchy fabric in both the MD (length) and CD (width) dimensions of the spun-laid web.

EXAMPLE 2

Figure 1C:
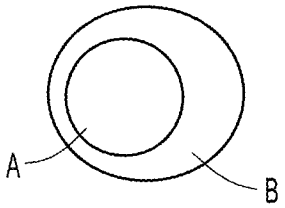
Figure 1B:
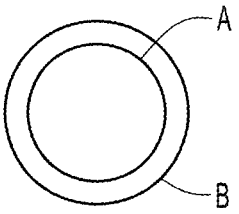
Figure 1D:
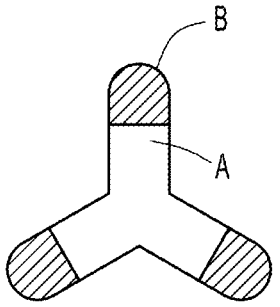
Figure 1E:
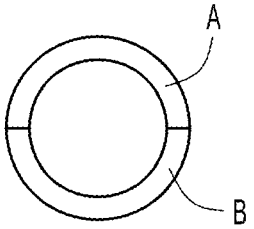
Figure 4:
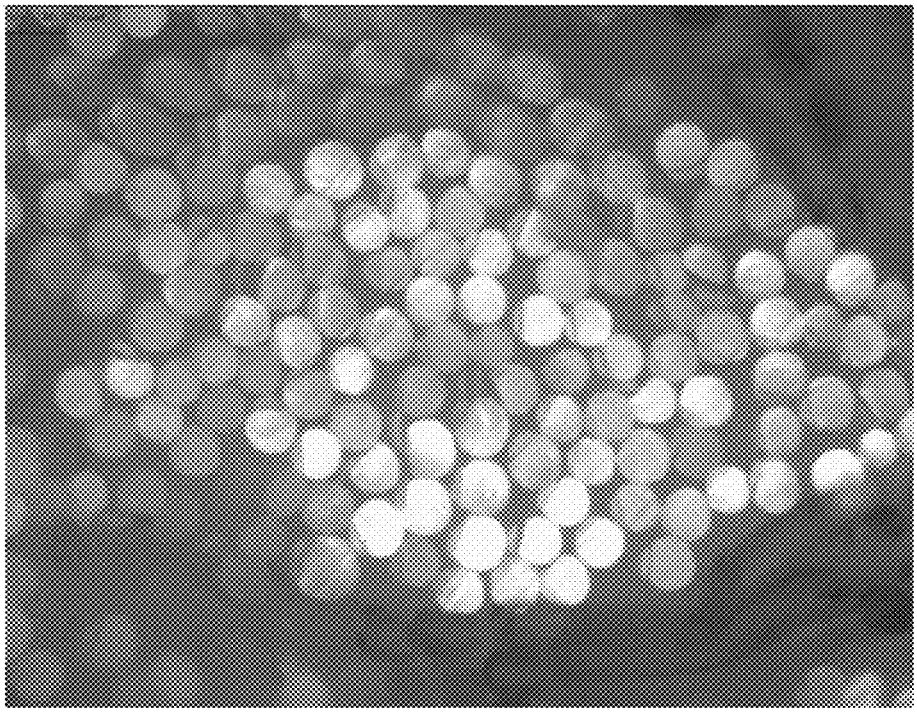
FIG. 4 is an image of the cross-section for a plurality of side-by-side fibers that form a spun-laid web in accordance with an example embodiment of the present invention.

A continuous filament spun-laid web was formed using a system similar to that depicted in FIG. 2, in which side-by-side bicomponent fibers were used to form the web (as depicted in FIG. 1A). The side-by-side components (components A and B) were the same PLA and polypropylene components used in Example 1. A cross-sectional view of a collection of such fibers formed is depicted in the image of FIG. 4. In response to activation utilizing a tank of boiling water (the same or similar activation process station as in Example 1), the spun-laid web exhibited very similar properties as the web described in Example 1 (increase in web thickness or Z-dimension, decrease in density, and enhanced web strength, web uniformity and web elasticity). While there was some fibrillation (for example, partial separation of polymer component A from polymer component B within a bicomponent fiber) in the fibers forming the web, this did not negatively affect the resultant properties of the web after activation. It was determined that spun-laid webs with desirable properties (significant chance in web thickness, web density and web elasticity) can be achieved even when using volume ratios of PLA to polypropylene as low as about 5% by volume PLA within the fibers.

EXAMPLE 3

A plurality of different continuous filament spun-laid webs were formed using a system similar to that depicted in FIG. 2, in which the webs included side-by-side bicomponent fibers of two types, solid (as depicted in FIG. 1A) and hollow (as depicted in FIG. 1E), and sheath-core bicomponent fibers (as depicted in FIG. 1B and/or 1C). The polymer components (components A and B) for each of the webs formed were the same polylactic acid (PLA) and polypropylene (PP) components used in Example 1, but at different volumetric bicomponent ratios for the different webs. After each continuous filament spun-laid web was formed and activated, a series of tests were conducted for each activated web to determine certain characteristics of the web, such as web loftiness, web strength and web elasticity. The test data for each web is provided in Tables 1-5.

TABLE 1

Continuous Filament Spun-laid Webs formed

| | PP/PLA volumetric ratio | Fiber Cross Section | Denier | Basis Weight ($g/m^2$ or GSM) | Thickness (mm) | Density ($g/cm^3$) |
|---|---|---|---|---|---|---|
| Sample 1 | 90/10 | hollow side-by-side | 3.00 | 423 | 22.5 | 0.019 |
| Sample 2 | 75/25 | solid side-by-side | 2.00 | 497 | 23.0 | 0.022 |
| Sample 3 | 80/20 | Hollow side-by-side | 4.00 | 663 | 12.0 | 0.060 |
| Sample 4 | 70/30 | sheath-core (PP in sheath) | 1.50 | 273 | 12.0 | 0.020 |
| Sample 5 | 70/30 | Sheath-core (PP in sheath) | 1.50 | 58 | 1.0 | 0.058 |

TABLE 2

Tensile Strength Evaluation

| | Tensile Strength - MD (gram-force/$cm^2$) | Tensile Strength - CD (gram-force/$cm^2$) | Tensile Strength - MD (gram-force/cm/gsm) |
|---|---|---|---|
| Sample 1 | 806 | 3717 | 4.29 |
| Sample 2 | 1609 | 3800 | 7.44 |
| Sample 3 | 1458 | | 2.64 |
| Sample 4 | 343 | 356 | 1.51 |
| Sample 5 | 2000 | 1100 | 3.45 |

TABLE 3

Elongation Evaluation

| | Elongation % MD | Elongation % CD | Tear MD (kg) | Tear CD (kg) |
|---|---|---|---|---|
| Sample 1 | 138 | | 7.86 | 4.58 |
| Sample 2 | 250 | 239 | 1.29 | 3.48 |
| Sample 3 | 320 | 94 | 1.58 | |
| Sample 4 | 30 | 68 | 0.61 | |
| Sample 5 | 115 | 447 | 1.527 | 0.953 |

TABLE 4

| Elongation Recovery Evaluation | | | | | | | | |
|---|---|---|---|---|---|---|---|---|
| | Stretch % (100 g) | Recovery % | Stretch % (200 g) | Recovery % | Stretch % (300 g) | Recovery % | Stretch % (500 g) | Recovery % |
| Sample 4 | 16 | 67 | 28 | 67 | 40 | 60 | 58 | 55 |

TABLE 5

| Loftiness Evaluation | | | | | |
|---|---|---|---|---|---|
| | IFD 25% (gram-force/cm$^2$) | IFD 65% (gram-force/cm$^2$) | Support Factor | IGRL - 110 N (% crush) | IGRL - 220 N (% crush) |
| Sample 1 | 0.51 | 6.11 | 12 | 13% | 7% |
| Sample 2 | 2.55 | 51.2 | 20 | 48% | 35% |
| Sample 3 | 4.71 | 199 | 42.25 | 68% | 58% |

Each sample was weighed to determine its basis weight (g/cm$^2$ or gsm). The thickness of each sample was determined per ASTM D3574 at a pressure of 100 Pa. The density of each sample was determined based upon the determined basis weight and thickness of the sample.

For the tensile strength and elasticity (elongation) tests, each web sample comprised a test specimen of 150 mm by 30 mm. The apparatus for performing the test was a hanger hook on a graduated board with weights to hang from each specimen. A clamp was hung at a bottom end of each specimen (when the specimen was aligned along the MD dimension or the CD dimension) with a selected weight to determine the strength of the specimen as well as record any elastic elongation of the specimen (see Tables 2 and 3). When the weight was removed for certain specimens, the recovery of the specimen was further recorded (see Table 4), where recovery of the specimen represents the dimension of the web specimen after removal of the weight load applied to the web specimen and comparing this recovered dimension with the original dimension (i.e., dimension of the specimen prior to any loading of weight on the specimen).

The tensile strength of each sample (shown in Table 2) was determined in both the MD and CD dimensions of the web from which the sample was taken using an INSTRON® tensile tester commercially available from Illinois Toolworks Inc. and where a sub-sample for the tensile strength test of 2.5 cm in width was used. As described in Table 2, the tensile strength is characterized by a force per sample area (gram-force/cm$^2$) and a force per sample width and sample basis weight (gram-force/cm/gsm).

The elastic elongation in both MD and CD dimensions for each sample was also determined (also shown in Table 2) using the INSTRON® tensile tester. In addition, each sample was loaded with a weight to failure, indicating a value (kg) for tear (tearing of the web sample) in both the MD and CD dimensions (shown in Table 2).

The loftiness of each sample was evaluated based on utilizing an indentation force deflection (IFD) test performed according to ASTM D3574. In particular, an apparatus was utilized having a flat circular indenter foot 100 +3/−0 mm in diameter, connected with a swivel joint for applying forces to the specimens, where the indenter foot was mounted over a level horizontal platform. The distance between the indenter foot and the platform is variable to indent the specimen for thickness measurements. The apparatus is further provided with a device for measuring the distance between plates. Test specimens of the different samples were provided having dimensions of 190 mm by 190 mm. Each test specimen was placed on the platform, and the area to be tested was preflexed lowering and raising the indenter foot to a total deflection of 75% of the full-part thickness allowing the indenter to fully clear the top of the specimen after each preflex. Each specimen was then deflected 25% of the original thickness (i.e., compression or deflection of the web such that the web thickness is reduced by 25%) and the IFD was measured in gram-force/cm$^2$ (results in Table 5). The deflection for each specimen was then increased to 65% deflection (i.e., compression or deflection of the web such that the web thickness is reduced by 65%), and the IFD was measured in gram-force-cm$^2$ (see Table 5). A support factor (65% IFD/25% IFD) was also determined (see Table 5). Forces of 110 N (Newtons) and 120 N were also applied to each specimen to determine a % crush value for the specimen (where % crush indicates a change in thickness from the original or starting thickness to a final thickness with the force applied to the specimen). As indicated by the data provided herein, some of the loftier webs exhibited both a tensile strength of at least about 300 gram-force/cm$^2$ an indentation force deflection (IFD) of at least about 5 gram-force/cm$^2$ when the web was deflected to reduce web thickness by 65%.

EXAMPLE 4

A plurality of different continuous filament spun-laid webs were formed using a system similar to that depicted in FIG. 2, in which the webs included side-by-side bicomponent fibers of the hollow round type (as depicted in FIG. 1E). The polymer components (components A and B) for each of the webs formed were the same polylactic acid (PLA) and polypropylene (PP) components used in Example 1. Each of the webs had the same basis weight (300 gsm) but differed in density after activation. Samples were taken from each web, and the entangled fibers formed within each activated web sample were examined under magnification to measure loop diameters or loop lengths of fibers within the webs (where a loop diameter or loop length is the length of a closed, defined loop portion of a fiber). The largest loop diameters for each web were recorded and are further provided in Table 6. In addition, a deflection force was applied to each web sample by placing a weight on the sample and comparing the original web thickness with the compressed web thickness. This data is also provide in Table 6.

TABLE 6

Loftiness/Fiber Loop Evaluation for Different Web Samples

| | Web density ($g/cm^3$) | Loop length (microns) | Original web thickness (mm) | Compressed web thickness (mm) | Weight applied (gram-force) |
|---|---|---|---|---|---|
| Sample 1 | 0.119 | 100 | 8.128 | 7.874 | 1 |
| Sample 2 | 0.032 | 300 | 16.764 | 12.954 | 2 |
| Sample 3 | 0.069 | 220 | 13.208 | 12.192 | 2.8 |
| Sample 4 | 0.047 | 250 | 14.224 | 11.176 | 2.6 |
| Sample 5 | 0.042 | 300 | 17.018 | 13.462 | 2.94 |
| Sample 6 | 0.018 | 480 | 24.13 | 12.192 | 3 |
| Sample 7 | 0.034 | 400 | 19.304 | 13.716 | 2.9 |
| Sample 8 | 0.014 | 1100 | 24.13 | 8.89 | 2.7 |

In the webs formed in this example, the loftier webs are indicated by larger thickness and larger fiber loop length dimensions as well as smaller density dimensions. As can be seen, sample 8, having the greatest loop length dimension (representing largest loop amplitudes for fibers) and greatest thickness, also exhibited the greatest degree of compression (ratio of original thickness to compressed thickness) when weight was applied to the web sample. In contrast, samples 6 and 7, while having thicknesses similar to sample 8, had loop length dimensions that were significantly smaller in relation to sample 8. Further, samples 6 and 7 had a smaller degree of compression in relation to sample 8 when subjected to similar weight loads.

EXAMPLE 5

A plurality of different continuous filament spun-laid webs were formed using a system similar to that depicted in FIG. 2, in which the webs included side-by-side bicomponent fibers of the hollow round type (as depicted in FIG. 1E). The polymer components (components A and B) for each of the webs formed were the same polylactic acid (PLA) and polypropylene (PP) components used in Example 1. In a first series of webs formed, the bicomponent volumetric ratio of polymer components was modified for webs formed having the same starting or pre-activation basis weight of 200 gsm and pre-activation thickness of 1.5 mm. After activation, the final density, basis weight and thickness of each web was determined so as to correlate bicomponent ratio for a web (with same pre-activated basis weight and thickness) with final or post activation density, basis weight and thickness. The results are provided in Table 7

TABLE 7

Comparison of bicomponent ratio within web with effect on activated web density and thickness

| | Web Bicomponent Ratio PP/PLA (Vol. %) | | | | |
|---|---|---|---|---|---|
| | 50:50 (Sample 1) | 60:40 (Sample 2) | 70:30 (Sample 3) | 80:20 (Sample 4) | 90:10 (Sample 5) |
| Web thickness after activation (mm) | 7 | 7 | 15 | 20 | 25 |
| Web basis weight after activation | 1371 | 1057 | 846 | 653 | 290 |
| Web density after activation ($kg/m^3$) | 195.9 | 151 | 56.4 | 32.7 | 11.6 |

The data of Table 7 indicates that varying of bicomponent ratios for the same fiber geometry in the webs formed in accordance with the present invention can have an impact on loftiness of the web (for example, increase in web thickness and decrease in web density) after activation.

Webs were also formed having the sample fiber type (hollow round side-by-side) and with a bicomponent ratio of polypropylene to PLA of 90:10 for fibers forming each web, but with a different basis weight for each web. After activation of each web, the resultant thickness, basis weight and density for each web was measured, and the results are provided in Table 8.

TABLE 8

Comparison of basis weight modification for web with final, activated web density, basis weight and thickness

| | Sample 6 | Sample 7 | Sample 8 | Sample 9 | Sample 10 | Sample 11 |
|---|---|---|---|---|---|---|
| Initial (pre-activated) web basis weight (gsm) | 100 | 200 | 300 | 400 | 500 | 700 |
| Initial (pre-activated) web thickness (mm) | 1.1 | 1.5 | 1.8 | 2.0 | 2.3 | 2.8 |
| Final (activated) web thickness (mm) | 29.8 | 40.5 | 53 | 59.4 | 57.4 | 65.3 |
| Final (activated) web basis weight (gsm) | 254 | 251.75 | 438 | 503 | 490 | 640 |
| Final (activated) web density ($kg/m^3$) | 8.52 | 6.22 | 8.26 | 8.47 | 8.54 | 9.80 |

While the previously described examples describe fibers formed in the spun-laid web having sheath-core and side-by-side (solid and hollow) configurations including PLA and polypropylene, other spun-laid webs can also be formed in accordance with the invention and which comprise fibers having different cross-sectional configurations as well as different types of polymer components.

The activated spun-laid webs formed in accordance with the present invention have a variety of useful applications. For example, the spun-laid webs formed in accordance with the present invention can be used for insulation products (for example, insulation in residential homes or commercial buildings for thermal and/or sound barrier properties), as filter material for particular applications, as filler material for a wide variety of products (such as padding material within jackets, shoes, quilted products, etc.), as packaging material, as an absorbent material (for example, for oil or other liquids), as a wrapping material, as cleaning pads and/or cleaning wipes (wet or dry), as an artificial leather substrate, as barrier fabric materials fr use in medical (for example, wound care) and/or hygiene applications, as geotextile materials and as agricultural fabric materials.

As previously noted, a spun-laid web product can be provided for commercial use having been activated to its bulky or lofty state. Alternatively the spun-laid web product can be provided for commercial use in its pre-activated or lofty potential state, where the consumer at the use endpoint activates the web product (for example, by application of heat from a suitable heat source, such as a hot air dryer or other device).

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed:

1. A method of forming a continuous filament spun-laid web, the method comprising:

extruding a plurality of polymer fibers from a spinneret;

collecting the plurality of fibers on a support surface to form a web of fibers, the web including fibers with different polymer components; and activating the web while the web is un-restrained to entangle the fibers within the web, wherein the activation of the web causes an increase in thickness of the web and an interlocking of fibers that, without any thermal or mechanical bonding treatment, results in:

the web being configured to withstand an elastic elongation from about 10% to about 350% in a machine direction (MD) of the web and/or a cross-direction (CD) of the web; and/or the web having a tensile strength from about 50 gram-force/$cm^2$ to about 5000 gram-force/$cm^2$.

2. The method of claim 1, wherein the activation of the web comprises heating the web while the web is un-restrained.

3. The method of claim 2, further comprising:

winding the web on a collection roll prior to activation of the web.

4. The method of claim 1, further comprising:

bonding the web after the activating of the web, wherein the bonding comprises mechanical bonding and/or thermal bonding.

5. The method of claim 1, wherein the extruding comprises extruding polymer fibers including two or more different polymer components.

6. The method of claim 5, wherein at least two of the polymer components comprise polypropylene and polylactic acid.

7. The method of claim 5, wherein the extruding further comprises extruding fibers having cross-sections selected from the group consisting of side-by-side, multilobal, sheath-core, islands-in-the-sea, solid round, and hollow round.

8. The method of claim 7, wherein two or more fibers are extruded having different fiber cross-sections.

9. The method of claim 7, wherein the extruding further comprises extruding bicomponent fibers having a volumetric ratio from 50% to 95% of a first polymer component and from 5% to 50% of a second polymer component.

10. The method of claim 1, wherein the extruding further comprises extruding polymer fibers such that two or more stacked layers of fibers are formed within the web.

11. The method of claim 1, wherein the activation of the web further results in a change in density of the web post activation in relation to a density of the web prior to activation.

* * * * *